US005466505A

United States Patent [19]

Fukuda et al.

[11] Patent Number: 5,466,505

[45] Date of Patent: Nov. 14, 1995

[54] NAPPED FABRIC AND PROCESS FOR ITS PRODUCTION

[75] Inventors: Keiji Fukuda, Kurashiki; Isao Tokunaga, Okayama-Pref.; Takao Akagi, Kurashiki, all of Japan

[73] Assignee: Kuraray Company Limited, Kurashiki, Japan

[21] Appl. No.: 170,636

[22] Filed: Dec. 21, 1993

Related U.S. Application Data

[62] Division of Ser. No. 19,346, Feb. 18, 1993, abandoned, which is a continuation of Ser. No. 654,049, Feb. 12, 1991, abandoned.

[30] Foreign Application Priority Data

Mar. 2, 1990 [JP] Japan ..... 2-52292
Jul. 6, 1990 [JP] Japan ..... 2-180319

[51] Int. Cl.[6] ..... B32B 33/00; D06C 11/00; D02G 3/00

[52] U.S. Cl. ..... 428/91; 428/92; 428/97; 428/373; 428/399; 428/400

[58] Field of Search ..... 428/373, 92, 16, 428/375, 395, 397, 400, 399, 91, 97

[56] References Cited

U.S. PATENT DOCUMENTS 4,525,404 6/1985 Matsui et al. ..... 428/373 X
5,407,735 4/1995 Fukuda et al. ..... 428/224

FOREIGN PATENT DOCUMENTS 134141 3/1985 European Pat. Off. .
50-40195 12/1975 Japan .
55-112306 8/1980 Japan .
55-112385 8/1980 Japan .
137241 10/1980 Japan .
55-137241 10/1980 Japan .
56-134272 10/1981 Japan .
56-140167 11/1981 Japan .
57-154435 8/1982 Japan .
57-133220 8/1982 Japan .
154435 9/1982 Japan .
58-65034 4/1983 Japan .
065034 4/1983 Japan .
0197309 11/1983 Japan ..... 428/399
1201549 8/1989 Japan .

OTHER PUBLICATIONS

Translation of JP 57–133220 (Ishida et al.), Aug. 17, 1982.

*Primary Examiner*—George F. Lesmes
*Assistant Examiner*—Terrel Morris
*Attorney, Agent, or Firm*—Oblon, Spivak, McClelland, Maier & Neustadt

[57] ABSTRACT

Provided are napped fabrics with naps comprising a tapered fiber of a sheath-core polyester fiber with the sheath component having larger alkali hydrolysis rate than the core component, the core of the tapered fiber being exposed at its end part and having smooth surface, the sheath of at least the tapered part having minutely roughened surface. The napped fabrics are of high quality, having good hand and excellent color developing property without unnatural luster such as dark fading or white appearance and being difficult to soil, and are hence markedly suited for car seat cover.

5 Claims, 1 Drawing Sheet

NAPPED FABRIC AND PROCESS FOR ITS PRODUCTION

This application is a Division of application Ser. No. 08/019,346, filed on Feb. 18, 1993, now abandoned.

BACKGROUND OF THE INVENTION

1. Field of the Invention

The present invention relates to polyester-based napped fabrics having a hand resembling that of animal hair and an excellent appearance with high-quality feeling, and having good HARI (anti-drape stiffness) and KOSHI (stiffness), which are usable in a wide variety of end-uses including interior fabrics such as car seat covers and carpets, artificial suedes and clothing. The present invention also relates to tapered fibers constituting the above fabrics and a process for producing such fibers.

2. Description of the Prior Art

Napped fabrics such as standard cut-pile, moquette, double-raschel, velour and velvet have various appearances and hands and have been widely used as interior fabrics such as car seat covers, carpets and flocked fabrics, as well as artificial suedes and clothing.

Napped fabrics with their naps comprising polyester fiber however have stiffer tactility and are significantly poorer in appearance such as luster and brightness, than those with naps made of fibers of acrylic, nylon and rayon, cotton, wool and the like. Besides, when these polyester-based napped fabrics are dyed, they hardly give mild luster like that of napped fabrics made of natural fibers such as wool and silk, and their hand lacks natural feeling, and it is difficult to give them deep color.

For the purpose of improving the appearance and hand of polyester-based napped fabrics there have been proposed various processing techniques, among which the one of tapering naps of napped fabrics made from polyester fiber is important. Various tapering techniques have so far been proposed and most of those that give comparatively good tapered shape of polyester fiber utilize hydrolyzability of polyester.

Japanese Patent Publication No. 40195/1975 discloses a representative process of the above tapering techniques, which utilizes the hydrolyzability of polyester and capillary phenomenon and comprises immersing the ends of polyester fiber naps in an alkali solution and heating the solution to make the naps taper to the ends. For naps having a large length, this process can provide naps being tapered to some extent along their length. For shorter naps such as moquette, velour and velvet, this process however gives poor fabrics being of low strength, too flexible or lacking high quality feeling, since in sufficiently hydrolyzing the ends it hydrolyzes also up to the roots of naps, thereby making fine the whole naps.

Furthermore, when napped fabrics made of conventional polyester fiber are etched to give not sufficiently tapered naps, their dyed products will tend to produce unnatural luster or color, such as "dark fading" or "white appearance" caused by diffused reflection of light. Then, they become inferior to napped fabrics of natural fiber such as wool and silk in the brightness and deepness of color, in mild luster and in natural feeling.

Improvements have also been made in the technique of forming fabrics having tapered naps from polyester fiber.

For example Japanese Patent Application Laid-open No. 133220/1982 discloses a process which comprises tapering by etching a sheath-core composite fiber comprising a cation-dyable polymer. While this process improves to some extent, but not sufficiently, the brightness and deepness of color, it can hardly improve the other drawbacks. Japanese Patent Application Laid-open No. 154435/1982 discloses a process which comprises tapering by etching a sheath-core composite fiber composed of a core polymer containing a delusterant and a sheath polymer having nearly the same hydrolyzing rate as that of the core polymer. No improvements in the development of color and the luster can be expected from this process.

Japanese Patent Application Laid-open No. 65034/1983 discloses a technique which comprises etching a composite fiber having a radiated cross section and containing a delusterant, in a rotating bath containing solely a hydrolyzing agent, thereby providing a tapered fiber by action of centrifugal force. The rates of hydrolysis of the two polymers used in this process are about the same, and the etched fiber does not produce effect of the color development through roughened surface, whereby it gives only light color when dyed.

Japanese Patent Application Laid-open No. 140167/1981 discloses a process for producing artificial fur which comprises treating a napped fabric made of tomenta and pinfeathers of a sheath-core composite fiber having a fineness of 20 to 70 deniers and comprising two polymers having different hydrolyzability, with a hydrolyzing agent containing a thickener, thereby removing the more readily hydrolyzable polymer by hydrolysis. This process however cannot provide a high-quality napped fabric since the naps thus treated give a shining appearance.

Japanese Patent Application Laid-open No. 134272/1981 discloses a technique for splitting the ends of naps which comprises treating naps of a composite fiber comprising two polymers having different hydrolyzability and having a cross section of multilayered or multi-core sheath-core type with a hydrolyzing agent, thereby removing the more readily hydrolyzable polymer. The naps thus treated by this process however are not tapered to the ends and the napped fabric hence shows an unnatural appearance and tactility.

Japanese Patent Application Laid-open Nos. 112306/1980, 112385/1980, 137241/1980 and 201549/1989 disclose a technique which comprises alkali etching napped fabrics with naps made of a fiber containing fine particles, thereby permitting the naps to have roughened surface. The naps thus formed by this technique are however not tapered to the ends, and hence the finished napped fabrics are not improved so much in the hand and tactility, although they show better development of color when dyed. If the naps be ever tapered to the ends by this process, they will be cheap-looking in luster and tactility and liable to be soiled at the toughened surface of the ends, being thus unable to give high-quality feeling.

As stated heretofore, known techniques all fail to provide a high-quality fabric with naps comprising polyester-based synthetic fiber.

Development of a high-quality napped fabric having naps comprising polyester fiber is still strongly desired, since polyester fiber is superior, in durability and resistance to light and yielding of the naps, to other synthetic fibers and natural fibers.

SUMMARY OF THE INVENTION

As a result of an intensive study to obtain a high-quality napped fabric comprising naps of polyester fiber, the present inventors have found the following facts.

For the purpose of providing napped fabrics with high-quality feeling, it is essential that the ends of the naps have brilliant luster and some smoothness and be difficult to soil and the part other than the ends of the naps have an excellent color developing property and mild luster. Such napped fabrics can be obtained by:

i) using, for the naps raised on a base fabric, a sheath-core fiber in which the contents of delusterant and rates of alkaline hydrolysis of the sheath and the core are specified;

ii) applying a highly viscous aqueous solution containing a hydrolyzing agent and a thickener to the naps; and iii) heating the end part of the naps containing the above solution.

The thus treated naps are tapered from an appropriate middle part to the ends, to provide this tapered part with the above described specific luster and color, while the root part as well as fibers of the base fabric maintain their fineness without being decreased to a large extent. Then the fabric has calm and mild luster and excellent color developing property, without any unnatural luster or color such as dark fading or white appearance. The fabric moreover has a hand which is as soft and high-quality as fabrics made of natural fibers, and still has HARI and KOSHI, and its naps are difficult to soil.

Thus, the present invention provides a tapered fiber comprising a sheath-core composite polyester fiber tapered to at least one end thereof, said fiber satisfying the following conditions a) through c):

a) the ratio of the rates of alkali hydrolysis between the sheath component and the core component is:

$$1.1 \leqq \frac{\text{alkali hydrolysis rate of sheath component}}{\text{alkali hydrolysis rate of core component}} \leqq 15;$$

b) the core contains 0 to 0.2% by weight of a delusterant and the sheath at least 0.3% by weight thereof; and c) the tapered part other than that with exposed core forms irregularly roughened surface with the recessions having a diameter measured in a circumferential direction perpendicular to the fiber axis of 0.2 to 0.7μ and being present in a density of 10 to 1,000 pieces/100 $\mu^2$.

The present invention also provides a napped fabric comprising naps made of a tapered fiber satisfying the above conditions a) through c) and the following condition d):

d) the fiber has its core exposed at the end and is tapered to the end in a length of at least 20% of its whole raised length.

Preferably the fiber of naps of this napped fabric is a sheath-core composite fiber comprising a core of a polybutylene terephthalate polymer or a polyethylene naphthalate polymer and a sheath of a polyester and containing 0.3 to 5% by weight of a delusterant of particulate silica having an average particle size of not more than 0.2μ, particularly colloidal silica having an average particle size of not more than 0.08μ.

The present invention further provides a process for producing the above napped fabric which comprises applying an aqueous solution of hydrolyzing agent containing a thickener to the napped part of a napped fabric comprising naps made of a sheath-core composite polyester fiber in which the core contains 0 to 0.2% by weight of a delusterant and the sheath at least 0.3% by weight thereof and the ratio of the rates of alkali hydrolysis between the sheath component and core component is:

$$1.1 \leqq \frac{\text{alkali hydrolysis rate of sheath component}}{\text{alkali hydrolysis rate of core component}} \leqq 15;$$

and heating the fabric at 80° to 180° C., thereby permitting the ends of the naps to be tapered to the ends.

BRIEF DESCRIPTION OF THE DRAWINGS

A more complete appreciation of the invention and many of the attendant advantages thereof will be readily obtained as the same become better understood by reference to the following detailed description when. considered in connection with the accompanying drawings, wherein.

DETAILED DESCRIPTION OF THE PREFERRED EMBODIMENTS

Figure 1A:
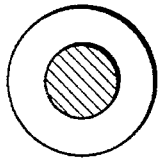
FIG. 1 shows representative cross-sectional views of the composite fibers of the present invention, in each of which the hatched part shows the core and the surrounding blank part the sheath; "*a*" showing co-centric circular cross section, "*b*", "*c*" and "*d*" irregularly-shaped cross sections and "*e*" a multi-core.
Figure 1B:
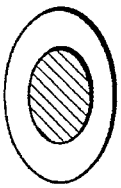
Figure 1C:
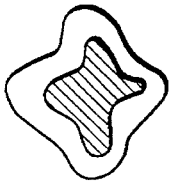
Figure 1D:
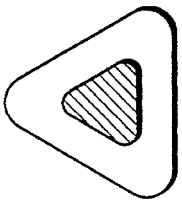
Figure 1E:
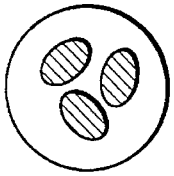

The sheath-core composite fiber herein means a composite fiber having a sheath-core cross section of single-core or multi-core as shown in FIG. 1. The composite fiber of the present invention is preferably made of a combination of polyester components that can be melt spun into composite fibers and are compatible with each other. It preferably has a single core and in this case may either be co-centric or eccentric. The cross section of the composite fiber or the core thereof may be circular or irregularly shaped. It is preferred that the weight ratio between the core component and the sheath component be in the range of from 20:80 to 70:30. The core component particularly preferred in the present invention is a polybutylene terephthalate polymer or a polyethylene naphthalate polymer, since they, among a variety of polyesters, give fibers that can readily be formed into tapered shape because of their slow rate of hydrolysis by alkali.

The polyester herein means a polyester which principally comprises units from ethylene terephthalate, butylene terephthalate or ethylene naphthalate and may contain other copolymerization units in an amount of less than 15 mol % based on the total moles of diol components or dicarboxylic acid components. Examples of the other copolymerization units are diethylene glycol, neopentyl glycol, cyclohexanedimethanol, isophthalic acid, sulfoisophthalic acid and its sodium salt and polyalkylene glycol. The polyester may contain additives such as luster improving agent, flame retardent and dyeability improving agent.

The polybutylene terephthalate polymer herein means a polyester derived principally from terephthalic acid and 1,4-butanediol and has the highest elastic property among polyesters and a low elastic modulus. Napped fabric with naps comprising polybutylene terephthalate therefore has a soft touch and excellent characteristics of compressional elastic recovery.

The polyethylene naphthalate polymer herein means a polyester derived principally from naphthalene-2,6-dicarboxylic acid and ethylene glycol. Among its species, polyethylene naphthalate homopolymer is higher in strength and Young's modulus than polyethylene terephthalate by 30 to 50% and has a glass transition temperature of about 113° C., which is 40° C. higher than that of polyethylene terephthalate, showing its high thermal resistance. Thus, napped fabric with naps comprising polyethylene naphthalate fiber exhibit, when used for example as an interior material of car, such as seat cover, excellent resistance to yielding and light in the summer where the temperature in the car becomes very high.

Sheath-core composite fibers are prepared from a core component of the above polybutylene terephthalate polymer or polyethylene naphthalate polymer and a sheath component of a polyester, e.g. polyethylene terephthalate, having higher rate of hydrolysis by alkali than the polybutylene terephthalate or polyethylene naphthalate polymer used for the core. These composite fibers form, by application of the alkali etching process of the present invention, ideally tapered shapes, and napped fabrics comprising naps of the thus tapered fibers produce excellent effects both in hand and appearance.

It is most preferred that the polyester of the sheath component be in particular polyethylene terephthalate, as shown in Japanese Patent Application Laid-open No. 107512/1980, containing 0.3 to 5% by weight based on the total sheath weight of colloidal silica having an average particle size of not more than 0.2μ, preferably not more than 0.1μ, more preferably not more than 0.08μ.

The delusterant used herein is a particulate inorganic substance that can decrease the transparency of the polymer used, and its examples include titanium dioxide, calcium carbonate, silica and kaoline. The ends of the raised naps of the napped fabric of the present invention must give a soft and smooth feeling when touched. For this purpose and for permitting the naps to keep luster and to be difficult to soil and easy to remove soil, a delusterant is added preferably in an amount not to cause the nap ends be roughened upon etching treatment. Thus the addition for the core should be not more than 0.2% by weight and may naturally be zero. On the other hand, the sheath of the tapered part is preferably of roughened surface to decrease the shining luster of the side of the fiber, and should therefore contain at least 0.3% by weight of a delusterant.

When a composite fiber with a sheath component polyester containing 0.3 to 5% by weight based on the total sheath weight of, in particular, colloidal silica or the like having an average particle size of not more than 0.2μ, preferably not more than 0.1μ, more preferably not more than 0.08μ is etched by alkali, the fiber forms irregularly roughened surface with randomly distributed projections and recessions. Then napped fabrics comprising naps of such fiber show, when dyed, brilliant and deep color and calm and mild luster. The above average particle size is herein measured by adsorption method (BET method).

In the present invention, the irregularly roughened surface means, typically, a surface on which projections having different heights and shapes and recessions having different depths and shapes are distributed randomly. It also includes a surface with projections having nearly the same height and recessions having different depths and a surface with projections having different heights and recessions having nearly the same depth.

In accordance with the present invention, it is important that, for the purpose of rendering milder the shining luster inherent to polyester fiber and at the same time increasing the color depth, of a napped fabric comprising naps made of a composite polyester fiber, that the naps be tapered to the ends, that the core of the composite fiber be exposed at the ends of the naps, and that the tapered part excluding the exposed-core part have irregularly roughened surface.

Besides the above, tapering the naps to the ends and in a length of 20% of the total nap length can still more efficiently suppress diffused reflection of light, thereby eliminating unnatural luster or color, such as dark fading and white appearance. In this case it is preferred that the tapered part be of a length of not more than 50% of the total nap length, since otherwise it will become difficult to keep the naps raising upright. The tapered part herein mean the part of a nap having a diameter substantially smaller, i.e. not more than 90%, than that at the root of the nap. For the projections and recessions forming the irregularly roughened surface on the sheath that improves color developing property, it is important that the distance, X, between the lowest point of a recession and that of another recession which is adjacent to the first one measured in a circumferential direction perpendicular to the fiber axis satisfy $0.2\mu<X<0.7\mu$, and that the recessions having different X's be present on the sheath of the fiber in a density of 10 to 1,000 pieces per 100 $\mu^2$ of the surface area. Here, X can be determined with a scanning electron microscope as a distance on plane.

If all the X's are less than 0.2μ or the number of recessions with X satisfying $0.2\mu<X<0.7\mu$ is less than 10 pieces per 100 $\mu^2$, the mirror reflectivity of the fiber will not decrease so much, whereby the napped fabric with naps of such fiber show a shining luster and a waxy touch. On the other hand, if all the X's are larger than 0.7μ, the napped fabric will have poor color developing property and become whitened when dyed. If the number of recessions satisfying $0.2\mu<X<0.7\mu$ is larger than 1,000 per 100 $\mu^2$, that means the surface is too minutely roughened, the napped fabric will again show mirror-like luster and be dull and whitened when dyed.

The sheath component of the napped fiber must contain at least 0.3% by weight of a delusterant. Otherwise, when the fiber is treated according to the process of the present invention, the sheath of the tapered part of the napped fiber will have a smooth or not sufficiently roughened surface. Then the napped fabric thus treated will, when dyed, be of too bright color and not of mild luster and natural hand, although the dyed fabric will be improved of unnatural luster or color, such as dark fading or white appearance.

In contrast, the fiber constituting the naps of the napped fabric of the present invention has such unique features greatly different from conventional tapered fibers as: having its core exposed at the end, being tapered to the end along its length in a length of at least 20% of the total length of the nap, and having the surface other than the exposed-core part minutely roughened with recessions and projections being randomly distributed in the above described density.

It is not necessary in the present invention that all the fiber surface other than the exposed-core part be minutely roughened. While the afore-described purpose of the present invention can be achieved with at least the tapered part other than the exposed-core part being minutely roughened, it is preferred, for the purpose of obtaining still milder luster and deeper color, that part other than the tapered part, i.e. part that is close to the root and is substantially not tapered be also minutely roughened. In this case, it is naturally not preferred to employ an etching process that will significantly decrease the fineness of the whole napped fiber.

Incident light reflects to a lesser extent from the fiber constituting the naps of the napped fabric of the present invention that has its core exposed at the end and is tapered to the end in a length of at least 20% of the total length. This is attributable to that: when rays of light incident on the surface of the napped fiber reflect from the minutely roughened surface, the reflecting rays interfere with each other and, besides, reflection and absorption of the incident light which occur successively around the recessions and projections weaken the reflection. In addition, tapering makes the fiber side surface undistinguishable from the cross section, whereby the fiber shows a property of developing bright and deep color and at the same time has a wool-like luster free from unnatural luster or color, such as dark fading and white appearance. The napped fabrics of the present invention provide high-quality feeling since they have excellent appearance and tactility and are resistant to soiling thanks to the above as well as the tapered exposed-core part of the naps showing a bright luster and smooth feeling.

Accordingly, the napped fabrics of the present invention produce, thanks to the tapering and unique surface structure of the naps, excellent tactility resembling napped fabrics made of natural fibers and excellent optical effect that cannot be obtained by conventional napped fabrics with tapered naps of conventional polyester or modified polyester fibers.

The napped fabrics of the present invention can be obtained from pre-treated napped fabrics comprising naps of the polyester sheath-core composite fiber and formed from any of knit pile, woven pile, moquette, double raschel, velour and velvet, or by tufting, electrical flocking or like processes. There are no specific restrictions to the preparation process of the pre-treated napped fabrics.

Napped fabrics suited for providing the tapered naps of the present invention have naps of not more than 10 mm length, preferably not more than 5 mm length. The effect of the present invention gradually decreases as the length becomes longer than 10 mm. The naps preferably have a density of $7\times10^3$ to $8\times10^6$ pieces/cm$^2$, more preferably $10^4$ to $2\times 10^5$ pieces/cm$^2$. With too high a nap density the thickened solution of hydrolyzing agent will not sufficiently penetrate; while appropriate tapered shape of the naps cannot be obtained with too low a nap density because of too deep penetration.

The fineness at the root of the naps of the composite polyester fiber is preferably 2 to 6 deniers. If the fineness of the root is too small, the naps will readily yield or lie flat and a fabric with such naps will have low KOSHI and become poorly napped fabric. In conventional napped fabrics, naps with a fineness of at least 3 deniers itch and give disagreeable feeling. On the other hand, in the napped fabrics of the present invention such itching is eliminated because of the tapered ends and hence applicable fineness can be larger, thereby improving the yielding property.

In the present invention, it is not necessary that all of the naps be the above-described tapered sheath-core composite fiber. Thus, the purpose of the present invention can in its own way be achieved with the tapered sheath-core composite fiber constitutes only part, for example 30%, of the total naps. It is however preferred that the tapered sheath-core composite fiber constitute at least 50% (in the number of pieces) of the naps.

The hydrolyzing agent used in the present invention includes alkaline compounds and their preferred examples are sodium hydroxide and potassium hydroxide. A hydrolysis accelerating agent, such as lauryldibenzylammonium chloride or cetyltrimethylammonium chloride, may be used in combination.

Any thickening agent can be contained in the hydrolyzing agent solution as long as it does not hydrolyze the polyester fiber used and forms a homogeneous solution when mixed into the hydrolyzing agent solution, and it preferably is a natural polymeric thickener such as starch, natural gum or sodium alginate or a synthetic polymeric thickener such as polyvinyl alcohol, sodium polyacrylate or styrene-maleic acid copolymer.

The aqueous solution of a hydrolyzing agent of for example sodium hydroxide and containing a thickener preferably has a concentration as defined by formula (1) of 1 to 30%.

$$\text{The concentration of hydrolyzing agent (wt \%)} = \frac{\text{Wt. of hydrolyzing agent}}{\text{Wt. of hydrolyzing agent + wt. of thickener + wt. of water}} \times 100 \quad (1)$$

The aqueous solution of a hydrolyzing agent and containing a thickener preferably has a viscosity at room temperature of at least 100 cps for the purpose of suppressing the hydrolyzing power and capillary phenomenon of the solution, thereby being able to obtain the desired tapered shape. Here, as high a viscosity as exceeding 20,000 cps will prevent the solution from sufficiently penetrating into the napped part.

Besides the above, for the purpose of treating a napped fabric comprising naps of sheath-core composite fiber with the above solution in such a way that the naps are tapered to the ends and the root part of the naps remain unetched by alkali, it is important that the ratio between the rates of alkali hydrolysis of sheath component and that of core component satisfy the following condition (a).

$$1.1 \leqq \frac{\text{alkali hydrolysis rate of sheath component}}{\text{alkali hydrolysis rate of core component}} \leqq 15 \quad (a)$$

The alkali hydrolysis rate of sheath component or core component of a composite fiber is herein determined by etching with the two homofil fibers separately prepared, one comprising only the polymer and additives constituting the sheath component and the other only the core component, and having the same fineness and number of filaments as those of the composite fiber, with an aqueous 40 g/l sodium hydroxide solution at 96° C. for 40 minutes.

If the above ratio exceeds 15, the sheath component will selectively be hydrolyzed, whereby the whole individual naps become thin to render the treated napped fabric low in KOSHI, the naps being tapered to a good shape though.

If the ratio is less than 1.1, the tapered shape aimed at by the present invention will not be obtained.

On the other hand, where the ratio between the rates of alkali hydrolysis of sheath component and that of core component of a sheath-core composite fiber satisfies the above condition (a), etching a napped fabric comprising naps of the fiber can provide the naps with the desired tapered shape aimed at by the present invention. In particular, where the core comprises polybutylene terephthalate or polyethylene naphthalate, both having a very low rate of alkali hydrolysis, and the sheath comprises polyethylene terephthalate and contains at least 0.3% by weight of a delusterant, the rate of alkali hydrolysis of the sheath is about 4 times that of polybutylene terephthalate and about 10 times that of polyethylene naphthalate. Then, upon alkali etching of this composite fiber, the naps are gradually etched with alkali and, at the same time, the alkali migrates to the ends of the fiber naps due to temperature gradient generated by heating. As a result, the ends of the naps are formed into ideally tapered shape, while the root part of the naps remains substantially unetched thus maintaining their fineness before the etching.

The hydrolyzing agent solution used in the present invention can be applied to the end part of naps by any process, such as gravure coating, kiss-coating, knife-coating, printing, rotary screen process or padding.

It however is preferred to employ padding among the above processes, which comprises for example passing a napped fabric, while keeping its napped face down, on a hydrolyzing agent solution in such a way that only the napped part of the fabric is immersed in the solution and then squeezing the fabric through a mangle to remove excess hydrolyzing solution. This process enables the naps to form minutely roughened surface down to the root part of the naps. In this case the mangle-squeezing ratio is preferably 30 to 70% by weight of remaining hydrolyzing solution based on the weight of the napped fabric, more preferably 40 to 60% by weight on the same basis. Further upon padding this way, the hydrolyzing agent solution preferably has a viscosity of 150 to 1,000 cps and an alkali concentration of 1 to 30% by weight where sodium hydroxide is used.

The napped fabric with the naps thus applied with a hydrolyzing agent solution by any one of the above processes is then heated by dry heating such as with hot air or infrared heater or wet heating such as steaming. Where dry heating is employed, there may often occur too early drying up of the hydrolyzing agent solution, thereby rendering it difficult to produce sufficient etching effect. To avoid this, it is desirable to select an appropriate heating system, temperature, time and the like depending on the composition and type of the fiber constituting the naps, type of the hydrolyzing agent solution and other conditions. It generally is preferred to wet heat at 80 ° to 180° C. for 5 to 120 minutes.

The level of the tapering of naps is preferably at least 20% of the total nap length as stated before.

If the tapering covers the whole or almost whole nap length, the naps will tend to become too flexible, thereby having low resilience and readily lying down, although they are markedly improved in color developing property and become free from unnatural color such as dark fading or white appearance. It is therefore recommendable to appropriately control the level of tapering by adjusting the viscosity, concentration and amount applied of the hydrolyzing agent solution, temperature and time of heating and like conditions.

Accordingly, the present invention provides napped fabrics resembling natural fur such as wool that have mild luster and good KOSHI and at the same time have soft hand, by employing a process completely different from conventional ones. The process comprises, to summarize, applying a viscous solution containing a hydrolyzing agent to the surface part or end part of the naps of a napped fabric that comprise polyester-based composite fiber and then heating the fabric, thereby tapering the end part of the naps. The process is of highly practical value, since it can readily produce on a commercial scale high-quality napped fabrics from readily available raw materials and at a low equipment cost.

The taper-napped fabrics thus obtained show, when dyed, bright and deep color and free from unnatural luster, such as dark fading or white appearance, which has been a drawback of polyester napped fabrics. This is because that the tapered fibers no longer have distinction between cross section and side surface and that reflection of incident light on the surface of the napped part is suppressed thanks to the effect of minutely and irregularly roughened surface that is formed on at least part of the total nap surface. The taper-napped fabrics also show high-quality appearance and excellent tactility because the tapered ends of naps have smooth feeling and excellent luster, and are further excellent in resistance to soiling and in desoiling property.

Other features of the present invention will become apparent in the course of the following descriptions of exemplary embodiments which are given for illustration of the invention and are not intended to be limiting thereof.

EXAMPLES

Example 1

A polybutylene terephthalate having an intrinsic viscosity before spinning of $[\eta]=1.07$ and containing no delusterant is named "polymer $P_1$". A polyethylene terephthalate incorporating colloidal silica having an average particle size of 40 mμ in an amount of 3.0% by weight and having an intrinsic viscosity before spinning of $[\eta]=0.68$ is named "polymer $P_2$".

The ratio of the alkali hydrolysis rates between $P_1$ and $P_2$, $P_2/P_1$, was 4. The two components were melt-composite spun, with polymer $P_1$ as core at an extrusion rate of 6.2 g/min and polymer $P_2$ as sheath at an extrusion rate of 12.4 g/min, into a composite fiber and the fiber was taken up at 1,000 m/min.

The yarn thus taken up was doubled and then drawn to a drawing ratio of 3.2 at 75° C. and then heat treated at 130° C. under tension to give a drawn sheath-core composite yarn of 100 deniers/24 filaments (single filament fineness: about 4 deniers) with a core/sheath weight ratio of ½.

The drawn yarn was knitted into a double raschel knit (pile density: 18,000 pieces/$cm^2$) with a knitting machine and with a ground yarn of polyester (75 deniers/24 filaments).

The knitted fabric thus prepared was sheared to be of cut pile length of about 3 mm and then dry pre-heatset at 180° C. through a pin tenter.

Hydrolyzing solutions containing sodium alginate as a thickener and having various compositions and viscosities as shown in Table 1 were separately applied with a rotary screen to the napped surface of the double raschel knit obtained above, and the knits were each treated with superheated steam in an H.T. steamer at 150° C. for 10 minutes.

Figure 2A:
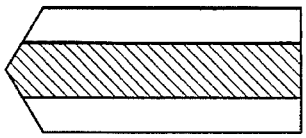
FIG. 2 shows schematic views of the lengthwise sections of various tapered fibers, in which "*a*" is mostly not tapered, "*b*" has its core not tapered, "*c*" and "*d*" are well tapered and constitute the fibers of the present invention, and "*e*" is entirely tapered.
Figure 2B:
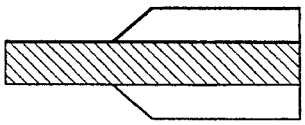

The thus treated double raschel knits were dyed with two types, blue and beige, of disperse dyes in a Obermeyer dyeing machine. The shapes of the end parts of specimens from the thus dyed knits were observed with an optical microscope to be as shown in FIG. 2, *c* and *d*. Among these knits, those having a gently tapered shape along 30% of the nap length as shown in FIG. 2*d*, i.e. No. 2 and No. 3 in Table 1, showed excellent hand and appearance and, while having a soft touch, still had a good HARI (anti-drape stiffness) and KOSHI (stiffness). They also showed a bright and deep color with no dark fading or white appearance and are difficult to soil, thus proving to be excellent high-quality napped fabric.

Figure 2C:
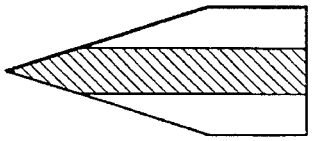
Figure 2D:
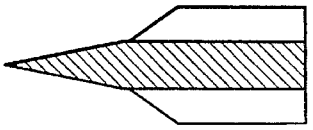

The knit of No. 1, which had a tapered nap shape as shown in FIG. 2*c*, also was of fairly high commercial value, its soft hand and depth and brightness of color being a little inferior to No. 2 and No. 3 though.

Scanning electron microscopy revealed that there are present recessions having a maximum breadth (diameter measured in a circumferential direction perpendicular to the fiber axis) of about 0.3μ in a density of 30 pieces/100 $\mu^2$ on the surface of sheath at the tapered part of the naps.

TABLE 1

| | No. 1 | No. 2 | No. 3 |
|---|---|---|---|
| Treating agent Composition | | | |
| NaOH | 130 g | 150 g | 200 g |
| Thickener | 30 g | 30 g | 50 g |
| Water | 840 g | 820 g | 750 g |
| Total | 1,000 g | 1,000 g | 1,000 g |
| Viscosity* | 9,000 cps | 12,000 cps | 17,000 cps |
| Amount applied | 400 g/m$^2$ | 450 g/m$^2$ | 570 g/m$^2$ |
| Shape tapered | FIG. 2c 25% of length tapered | FIG. 2d 30% of length tapered | FIG. 2d 30% of length tapered |
| Hand | ○ | ◎ | ◎ |
| Appearance | ○ | ◎ | ◎ |

Notes: Hand and appearance were evaluated by the following ratings.
◎: excellent, ○: good, Δ: marginal and X: poor
*Viscosity is measured with Type-B viscometer at 20° C., 65% RH.

Comparative Example 1

A polybutylene terephthalate having an intrinsic viscosity before spinning of [η]=1.14 and containing no titanium dioxide is named "polymer $P_3$". A polyethylene terephthalate incorporating titanium dioxide in an amount 0.2% by weight is named "polymer $P_4$".

The ratio of the alkali hydrolysis rates between $P_3$ and $P_4$, $P_4/P_3$, was 3. The two components were melt-composite spun, with polymer $P_3$ as core and polymer $P_4$ as sheath, and then drawn, under the same conditions as in Example 1 into a drawn sheath-core composite fiber of 100 deniers/24 filaments (single filament fineness: about 4 deniers) with a core/sheath weight ratio of ½.

The drawn yarn was knitted into a double raschel knit, which was then sheared to be of a pile length of 3 mm in the same manner as in Example 1. The napped fabric thus obtained was etched in the same manner as for No. 2 of Example 2, to give a taper-napped fabric having a tapered shape as shown in FIG. 2*a*.

Although the taper-napped fabric thus obtained had a good and soft hand, its appearance when dyed showed an insufficiently bright and deep color and a shining luster, which could not be said to be satisfactory. Scanning electron microscopy on the end part of the napped fiber revealed that there were present recessions in a number far below the range specified by the present invention.

Comparative Example 2

A polyethylene terephthalate containing a silica gel (average particle size: about 40 mμ) and having an intrinsic viscosity before spinning of [η]=0.75 is named "polymer $P_5$". A polyethylene terephthalate comprising 8 mol % of isophthalic acid copolymerization component and 6% by weight of polyethylene glycol kneaded thereinto, containing 0.08% by weight of titanium dioxide and having an intrinsic viscosity before spinning of [η]=0.81 is named "polymer $P_6$".

The ratio of the alkali hydrolysis rates between $P_5$ and $P_6$, $P_6/P_5$, was 75. The two components were melt-composite spun, with polymer $P_5$ as core at an extrusion rate of 12 g/min and polymer $P_6$ as sheath at an extrusion rate of 24 g/min, into a composite fiber and the fiber was taken up at 1,000 m/min.

The yarn thus taken up was drawn into a drawn sheath-core composite yarn of 90 deniers/24 filaments (single filament fineness: about 4 deniers) with a core/sheath weight ratio of ½.

The drawn yarn was formed in the same manner as in Example 1 into piles of a double raschel knit having a cut pile length of about 3 mm.

The hydrolyzing solution of No. 2 in Table 1 of Example 1 was applied with a rotary screen to the napped surface of the double raschel knit thus obtained, and the knit was treated with superheated steam at 150° C. for 8 minutes in an H.T. steamer.

Figure 2E:
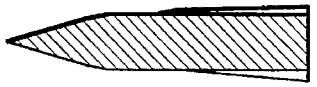

Although the thus treated double raschel knit had its naps tapered into a shape like FIG. 2*e* and good appearance, the naps had become thin to the root, since the rate of alkali hydrolysis of the sheath was far more than 15 times than that of the core and hence the sheath had been selectively hydrolyzed. As a result 90 to 100% of the nap length had been tapered. This napped fabric suffered yielding of the naps and thus had problem in durability, showing a soft touch though.

Example 2

A drawn sheath-core composite yarn of 200 deniers/96 filaments having a cross-sectional shape as shown in FIG. 1*a* was prepared. The core was a polybutylene terephthalate containing 0.08% by weight of titanium dioxide and having an intrinsic viscosity before spinning of [η]=1.1, and the sheath was a polyethylene terephthalate containing 0.6% by weight of titanium dioxide having an average particle size of 180 mμ, the weight ratio of core to sheath being ½ and the ratio of their rates of alkali hydrolysis being sheath/core=3.2.

The obtained yarn was formed into piles of a double raschel knitted fabric having a cut pile length of 3 mm in the same manner as in Example 1. Then the napped fabric was alkali-etched in the same manner as in No. 2 in Table 1 of Example 1 and then dyed.

The ends of the naps had been etched as shown in FIG. 2*d*, and part of the sheath surface carried recessions having an average maximum breadth of about 0.65μ in a density of 11 pieces/100 $\mu^2$. About 35% of the nap length had been tapered. The thus obtained napped fabric was of high quality, being excellent in appearance, luster, tactility, hand and resistance to soiling and fairly good in color developing property.

Comparative Example 3

A sheath-core composite yarn of 200 deniers/48 filaments was prepared. The core was a polyethylene terephthalate containing 1.5% by weight of silica having an average particle size of 0.07 μm, and the sheath was a polyethylene terephthalate containing 0.45% of titanium dioxide, the weight ratio of core to sheath being ½ and the ratio of their rates of alkali hydrolysis being sheath/core=0.95.

The obtained yarn was knit into a double raschel napped knit in the same manner as in Example 1. Then the napped fabric was alkali-etched in the same manner as in No. 1 in Table 1 of Example 1 and then dyed.

The ends of the naps had been etched as shown in FIG. 2*c*, while there were present 50 pieces/100 $\mu^2$ of recessions having an average maximum breadth of 0.3μ on the exposed core and 10 pieces/100 $\mu^2$ of recessions having an average maximum breadth of 0.7μ on the sheath surface. The thus obtained napped fabric had somewhat poorer luster and poorer tactility because of shortage of smooth feeling at the nap ends, as compared to the napped fabrics of the present invention. The fabric was also inferior in desoiling property for dust adhering to the surface.

Example 3

Hydrolyzing solutions containing sodium alginate as a thickener and having various compositions and viscosities as shown in Table 2 were separately applied by immersion through one dip-one nip padding rotary screen to the same double raschel knit as used in Example 1, and the knits were each heated with superheated steam at 175° C. for 8 minutes in a steamer.

The thus treated double raschel knits were dyed with two types, blue and beige, of disperse dyes in a Obermeyer dyeing machine. Observation with an optical microscope of the end parts of specimens from the thus dyed knits revealed that they had not been tapered and had the same shape as that of polyester fiber treated by immersion in the usual aqueous alkali solution. Although these knits were somewhat softer than they had been before the treatment, they lacked in the brightness and depth of color, showed marked dark fading and white appearance and were readily soiled.

TABLE 2

| | Example 3 | | | Comparative Example 4 | | |
|---|---|---|---|---|---|---|
| Sample No. | 1 | 2 | 3 | 4 | 5 | 6 |
| NaOH conc. | 17% | 21% | 24% | 17% | 21% | 24% |
| Thickener conc. | 5.25% | 3.5% | 2.63% | none | none | none |
| Viscosity* | 570 cps | 360 cps | 300 cps | 20 cps | 27 cps | 34 cps |
| Pick up | 49.5% | 50.2% | 53.1% | 43.1% | 48.0% | 45.9% |
| Reduction ratio | 19.3% | 25.8% | 29.5% | 18.9% | 24.1% | 29.0% |
| Shape tapered | FIG. 2c 25% of length tapered | FIG. 2d 35% of length tapered | FIG. 2d 45% of length tapered | Not tapered | | |
| Hand | ○ | ◎ | ◎ | X | Δ | Δ |
| Appearance | ○ | ◎ | ◎ | X | X | Δ |

Notes: Hand and appearance were evaluated by the following ratings.
◎: excellent, ○: good, Δ: marginal and X: poor
*Viscosity is measured with Type-B viscometer at 20° C., 65% RH.

The thus treated double raschel knits were dyed with two types, blue and beige, of disperse dyes in a Obermeyer dyeing machine. The shapes of the end parts of specimens from the thus dyed knits were observed with an optical microscope to be as shown in FIG. 2, *c* and *d*. Among these knits, those having a gently tapered shape along 30% of the nap length as shown in FIG. 2*d*, i.e. No. 2 and No. 3 in Table 2, showed excellent hand and appearance and, while having a soft touch, still had a good HARI and KOSHI. They also showed a bright and deep color with no dark fading or white appearance and are difficult to soil, thus being excellent high-quality napped fabric.

The knit of No. 1, which had a tapered shape as shown in FIG. 2*c*, also was of fairly high commercial value, its soft hand and depth and brightness of color being a little inferior to No. 2 and No. 3 though.

Scanning electron microscopy revealed that there were present recessions having a maximum breadth (diameter measured in a circumferential direction perpendicular to the fiber axis) of about 0.3μ in a density of 30 pieces/100 $\mu^2$ on the surfaces of the tapered part other than exposed-core part and substantially untapered part of the sheath of the naps.

Comparative Example 4

Alkali solutions containing no thickener as shown in Table 2 were each separately applied by padding in the same manner as in Example 3 to the same double raschel knit as used in Example 1, and the knits were each heated with superheated steam at 175° C. for 8 minutes in a steamer.

Example 4

A drawn sheath-core composite yarn of 200 deniers/96 filaments having a cross-sectional shape as shown in FIG. 1*a* was prepared. The core was a polyethylene-2,6-naphthalate and having an intrinsic viscosity before spinning of [η]=0.6, and the sheath was a polyethylene terephthalate containing 2.5% by weight of colloidal silica having an average particle size of 30 mμ and having an intrinsic viscosity before spinning of [η]=0.6, the weight ratio of core to sheath being ½ and the ratio of their rates of alkali hydrolysis being sheath/core=8.0. A double raschel knit having naps of the obtained yarn was prepared in the same manner as in Example 1. Then the napped fabric was alkali-etched in the same manner as in No. 3 of Example 3 and then dyed.

The end part of the naps had been etched as shown in FIG. 2*d*, about 25% of the nap length being tapered. There were found recessions having a maximum breadth of about 0.55μ in a density of 13 pieces/100 $\mu^2$ on the surface of the tapered part and substantially untapered part of the sheath of the naps. The thus obtained napped fabric was of high quality, being excellent in appearance, luster, tactility, hand and resistance to soiling. The napped fabric was evaluated for light fastness, to give grade 4 after being irradiated with carbon arc lamp at 80° C. for 200 hrs, which was good.

The napped fabric was also evaluated for yielding of naps. The fabric showed, after a weight of 40 g/$cm^2$ had been applied on the napped surface at 80° C. for 2 hours and then removed, no change in color shade and luster or yielding of naps.

Comparative Example 5

The hydrolyzing solution of No. 2 in Table 1 of Example 1 was applied by padding in a pick-up of 50.7% to the napped surface of the double raschel knit of Comparative Example 2, and the knit was heated with superheated steam at 150° C. for 8 minutes in a steamer.

Although the thus treated double raschel knit had its naps tapered into a shape like FIG. 2*e* and good appearance, the naps had become thin to the root, since the rate of alkali hydrolysis of the sheath was far larger than that of the core and the range specified in the present invention and hence the sheath had been selectively hydrolyzed. As a result 90 to 100% of the nap length had been tapered. This napped fabric suffered yielding of the naps and thus had problem in durability, showing a soft touch though.

Obviously, numerous modifications and variations of the present invention are possible in light of the above teachings. It is therefore to be understood that within the scope of the appended claims, the invention may be practiced otherwise than as specifically described herein.

What is claimed is:

1. A napped fabric comprising naps of a tapered fiber comprising a sheath-core composite polyester fiber tapered to at least one end thereof, said fiber satisfying the following conditions:

a) the ratio of the rates of alkali hydrolysis between the sheet component and the core component is:

$$1.1 \leqq \frac{\text{alkali hydrolysis rate of sheet component}}{\text{alkali hydrolysis rate of core component}} \leqq 15;$$

b) the core contains 0 to 0.2% by weight of a delusterant and the sheath at least 0.3% by weight thereof;

c) the tapered part other than that with exposed core forms an irregularly roughened surface with the recisions having a diameter measured in a circumferential direction perpendicular to the fiber axis of 0.2 to 0.7 μ and being present in a density of 10 to 1,000 pieces/100 $\mu^2$; and d) the fiber has its core exposed at the end and is tapered to the end in a length of at least 20% of its whole raised length;

wherein said naps have a nap length of not more than 5 mm.

2. A napped fabric according to claim 1, wherein said fiber is tapered to the end in a length of 20 to 50% of its whole raised length.

3. A napped fabric according to claim 1, wherein said sheath-core composite polyester fiber comprises a core comprising a polybutylene terephthalate polymer or a polyethylene naphthalate polymer and a sheath comprising a polyester and 0.3 to 5% by weight of a delusterant of silica having an average particle size of not more than 0.2μ.

4. The napped fabric of claim 1, wherein said sheath-core composite polyester fiber has a fineness of the substantially untapered part of 2 to 6 deniers.

5. The napped fabric of claim 4, wherein the ratio by weight of the core component to sheath component at the untapered part thereof is in the range of 20:80 to 70:30.

* * * * *